US006645375B2

(12) United States Patent
Henkin et al.

(10) Patent No.: US 6,645,375 B2
(45) Date of Patent: Nov. 11, 2003

(54) FLEXIBLE POWER CONDUIT FOR AUTOMATIC POOL CLEANERS

(76) Inventors: Melvyn L. Henkin, 1001 Sharon La., Ventura, CA (US) 93001; Jordan M. Laby, 1389 Beachmont, Ventura, CA (US) 93001

( * ) Notice: Subject to any disclaimer, the term of this patent is extended or adjusted under 35 U.S.C. 154(b) by 0 days.

(21) Appl. No.: 10/133,088

(22) Filed: Apr. 26, 2002

(65) Prior Publication Data

US 2002/0166804 A1 Nov. 14, 2002

Related U.S. Application Data

(60) Provisional application No. 60/289,436, filed on May 8, 2001.

(51) Int. Cl.[7] ..... E04H 4/16; B08B 3/02

(52) U.S. Cl. ..... 210/169; 15/1.7; 4/490; 134/168 R

(58) Field of Search ..... 210/169, 232; 15/1.7; 4/490; 134/167 R, 168 R; 138/103, 118

(56) References Cited

U.S. PATENT DOCUMENTS 3,238,549 A * 3/1966 Burlin et al. ..... 15/1.7
3,261,371 A * 7/1966 Vernon ..... 134/168 R
3,675,261 A * 7/1972 Burgess et al. ..... 15/1.7
3,860,518 A * 1/1975 Henricksen ..... 210/776
3,883,366 A * 5/1975 Blumenfeld ..... 134/52
4,017,331 A * 4/1977 Thoelen, Sr. ..... 134/167 R
4,087,286 A * 5/1978 Sexton et al. ..... 134/167 R
4,289,155 A * 9/1981 Sable ..... 134/167 R
4,346,484 A * 8/1982 Martin ..... 4/507
4,503,874 A * 3/1985 Norton ..... 134/167 R
4,839,063 A * 6/1989 Brooks ..... 210/780
5,557,819 A * 9/1996 Krolikowski ..... 15/1.7
6,119,707 A * 9/2000 Jordan ..... 134/93

* cited by examiner

*Primary Examiner*—Fred G. Prince
(74) *Attorney, Agent, or Firm*—Freilich, Hornbaker & Rosen

(57) ABSTRACT

A conduit assembly including a flexible elongate conduit for delivering operating power to a pool cleaner body which assembly includes multiple substantially rigid elongate buoyancy (positive or negative) members attached to the conduit for situating the conduit at a level between the pool water surface and floor surface to avoid obstructing the cleaner's movement along its travel path, whether at the water surface or at the floor surface.

34 Claims, 7 Drawing Sheets

FLEXIBLE POWER CONDUIT FOR AUTOMATIC POOL CLEANERS

RELATED APPLICATIONS

This application incorporates and claims the benefit of U.S. Provisional Application No. 60/289,436 filed May 8, 2001.

FIELD OF THE INVENTION

This invention relates generally to automatic cleaners configured to travel through a water pool for cleaning the water surface and/or the wall surface of a containment wall containing the water pool. Such cleaners are typically tethered to a power source by a flexible conduit such as a pressure hose, a suction hose, or an electric wire. The present invention is directed to conduit assemblies configured to situate the conduit between the water surface and wall (floor) surface by suspending the conduit below the water surface or anchoring the conduit above the floor surface to avoid obstructing the traveling cleaner.

BACKGROUND OF THE INVENTION

Automatic cleaners configured to travel through a water pool for cleaning the pool water surface and/or containment wall surface are well known in the art. Such cleaners include units which operate (1) solely at the wall surface (which shall be understood to include side and floor portions), (2) solely at the water surface, or (3) selectively at the water surface and wall surface (e.g., U.S. Pat. Nos. 5,985,156; 6,039,886; 6,090,219).

Such automatic pool cleaners are generally powered by energy delivered to the cleaner via a flexible elongate conduit, e.g., a pressure hose, a suction hose, an electric wire, etc. The delivered energy functions to propel the cleaner, typically along a substantially random travel path, while pulling the conduit behind it. Regardless of the energy form used, the flexible conduit tethered to the cleaner can obstruct or interfere with the cleaner's ability to travel through the pool. To avoid such interference, conduits are generally configured to reside out of the normal travel path of the cleaner. For example, conduits used with wall surface cleaners are generally configured (i.e., effective specific gravity <1.0) to float at the water surface to avoid the cleaner having to climb over the conduit. Similarly, water surface cleaners generally utilize a conduit configured (i.e., effective specific gravity >1.0) to sink to the wall surface, i.e., pool floor, to avoid obstructing the traveling cleaner.

SUMMARY OF THE INVENTION

The present invention is directed to a conduit assembly including an elongate conduit for delivering operating power to a pool cleaner body which assembly includes multiple substantially rigid elongate buoyancy (positive or negative) members attached to the conduit for situating the conduit at a level between the pool water surface and floor surface to avoid obstructing the cleaner's movement along its travel path, whether at the water surface or at the floor surface.

In accordance with the invention, a first conduit assembly embodiment includes a flexible conduit having an effective specific gravity >1.0. Multiple positive buoyancy members are attached to the conduit for suspending the conduit below the water surface to enable the cleaner to pass over the conduit as it travels along the water surface, as well as under the conduit as it travels along the floor surface. Each buoyancy member is attached to the conduit via a device which affords the buoyancy member freedom of movement relative to the conduit enabling the buoyancy member to be pushed out of the way by the cleaner (and/or the conduit) as the cleaner moves along its travel path.

An alternative second conduit assembly embodiment includes a flexible conduit having an effective specific gravity <1.0. In this embodiment, multiple negative buoyancy members, i.e., weight members, are attached to the conduit for anchoring the conduit so as to retain it above the wall surface (floor) and allow the cleaner traveling along the floor surface to pass under the conduit and traveling along the water surface to pass over the conduit. Each weight member is attached to the conduit via a device which affords the weight member freedom of movement relative to the conduit enabling the weight member to be pushed out of the way as the cleaner (and/or the conduit) moves along the floor surface.

A preferred conduit assembly in accordance with the invention employs a buoyancy member comprising a substantially rigid elongate member or "stick". The buoyancy stick has a first free end and a second end configured to be attached to the conduit in a manner which provides freedom of movement relative to the conduit. More particularly, a preferred device for attaching the buoyancy stick to the conduit includes a ring mounted for rotation around the conduit with the buoyancy stick second end mounted for hinged movement about a pivot axis defined by the ring. Sticks exhibiting positive buoyancy are able to float proximate to the surface and suspend a conduit having a specific gravity >1.0 below the water surface. Sticks exhibiting negative buoyancy are able to sink to the floor surface to anchor a conduit having a specific gravity <1.0 above the floor surface.

In use, the conduit first end is connected to a power source, e.g., a source of pressurized fluid, and the conduit second end is connected to the cleaner. The power delivered via the conduit propels the cleaner forwardly, pulling the flexible conduit behind. In accordance with a preferred embodiment of the invention, at least one propulsion device is carried by the conduit to produce a force for propelling the conduit and reducing the drag load on the cleaner. The force produced by the propulsion device is additionally transferred through the conduit to the cleaner to help randomly steer the cleaner.

Conduit assemblies in accordance with the invention enhance the operation of automatic pool cleaners by reducing obstructions to the cleaner's travel. Additionally, embodiments of the invention afford the advantage of removing the conduit from the water surface where it can interfere with normal pool skimming and diminish pool aesthetics.

DETAILED DESCRIPTION

Figure 1A:
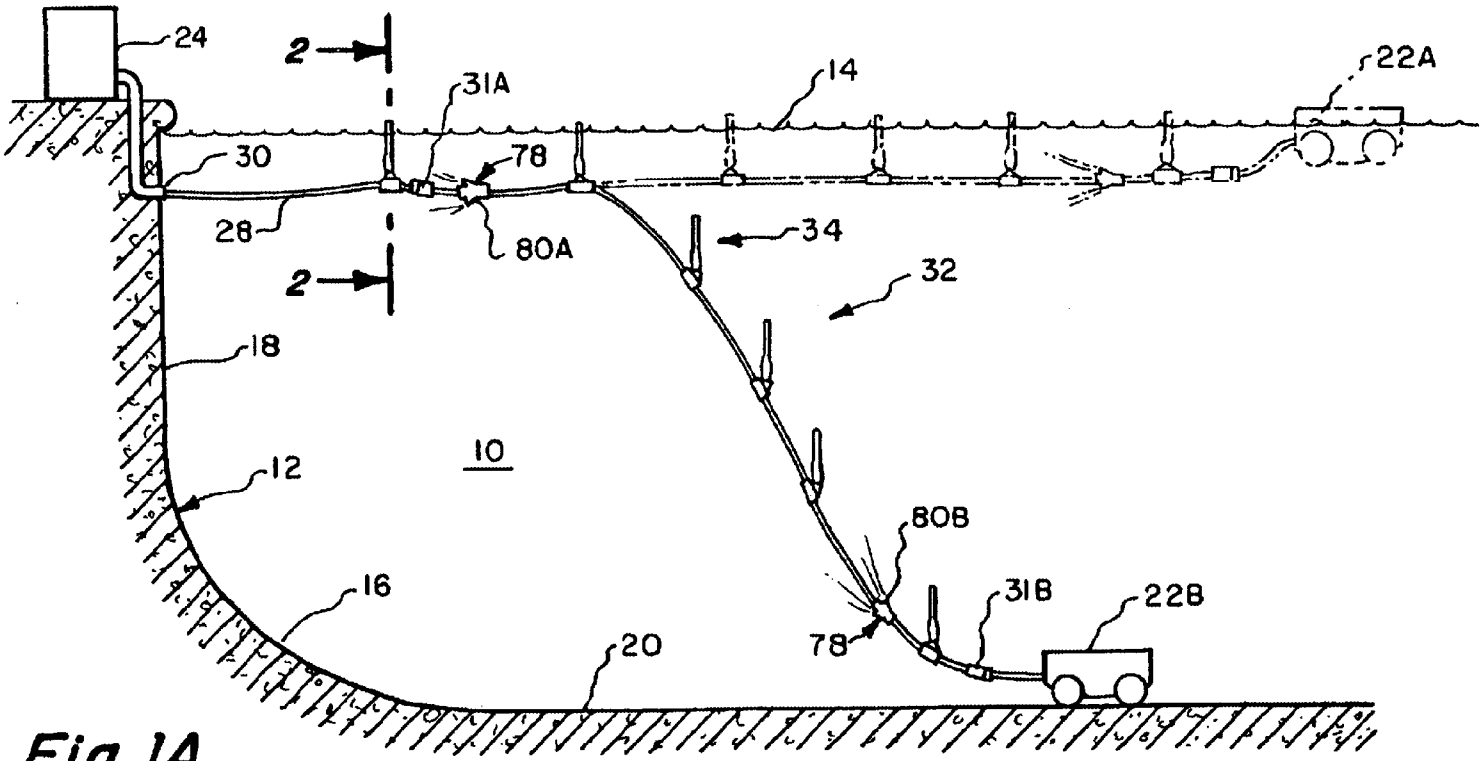
FIG. 1A is a schematic representation of a water pool showing a pool cleaner tethered to a power source via a flexible conduit and including buoyancy members in accordance with the invention for suspending the conduit below the water surface.

Attention is initially directed to FIG. 1A which schematically illustrates a water pool 10 contained by a containment wall 12. The pool 10 defines a water surface 14 and the wall 12 defines a wall surface 16 including side portions 18 and a bottom or floor portion 20.

Many automatic pool cleaners are described in the literature which include a cleaner body for traveling through a pool for cleaning a pool's water surface 14 and/or wall surface 16. FIG. 1A schematically depicts an exemplary pool cleaner body 22 (shown in dashed line 22A) configured to travel along the water surface 14 and an exemplary pool cleaner body 22 (shown in solid line 22B) configured to travel along the wall surface 16. It should be understood that the cleaner bodies (hereinafter, generally referred to as "cleaners") schematically represented at 22A and 22B in FIG. 1A can comprise separate alternative physical units or the same physical unit operating in different modes; i.e., in water surface mode (22A) and wall surface mode (22B). Typically, the pool cleaner 22 is coupled to a deck mounted power source 24 which supplies power to the cleaner via a flexible elongate conduit 28. Power supplied to the cleaner 22 typically functions to propel the cleaner through the pool along a travel path enabling it to capture water and debris as it moves along the path pulling the conduit behind it.

Various types of power sources 24 have been used in the prior art for powering pool cleaners. For example, power source 24 can supply a positive pressure fluid (typically water) to cleaner 22 via conduit 28, configured as a supply hose. Alternatively, power source 24 can apply a negative pressure (i.e., suction) to cleaner 22 via conduit 28, configured as a suction hose. Still further, power source 24 can supply an electric voltage to cleaner 22 via conduit 28, configured as an electric wire.

FIG. 1A depicts a conduit 28 as having a first or proximal end 30 coupled to the power source 24 via a fitting (not shown) at the wall portion 18 of surface 16. The second or distal end of the conduit 28 is coupled to the cleaner 22. Prior art conduits 28 intended to operate with wall surface cleaners are generally configured to float near the water surface to avoid obstructing the cleaner as it travels along the wall surface. On the other hand, conduits intended to operate with water surface cleaners may be configured to sink to avoid obstructing the movement of the cleaner along its water surface travel path. An exemplary conduit can be comprised of multiple short sections, e.g., 10 feet, connected together by swivel couplings, e.g., 31A, 31B.

The present invention is directed primarily to an enhanced conduit assembly particularly configured to avoid obstructing the cleaner's movement along its travel path. Embodiments of the invention are compatible with cleaners configured to operate (1) solely at the wall surface, (2) solely at the water surface, and (3) selectively at the water surface and wall surface.

FIG. 1A schematically depicts a preferred conduit assembly 32 in accordance with the invention comprised of a conduit 28 having a specific gravity >1.0. A plurality of buoyancy subassemblies 34 are attached to the conduit 28 spaced along its length for the purpose of suspending the conduit a fixed distance below the water surface 14 to allow the cleaner 22A traveling along the water surface to pass over the conduit.

Figure 1B:
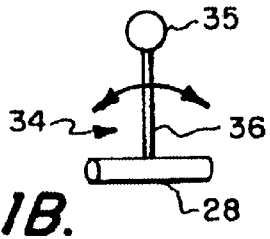
FIGS. 1B and 1C schematically depict an exemplary buoyancy member for suspending the conduit and mounted for movement relative thereto.
Figure 1C:
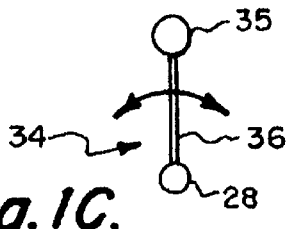
Figure 2:
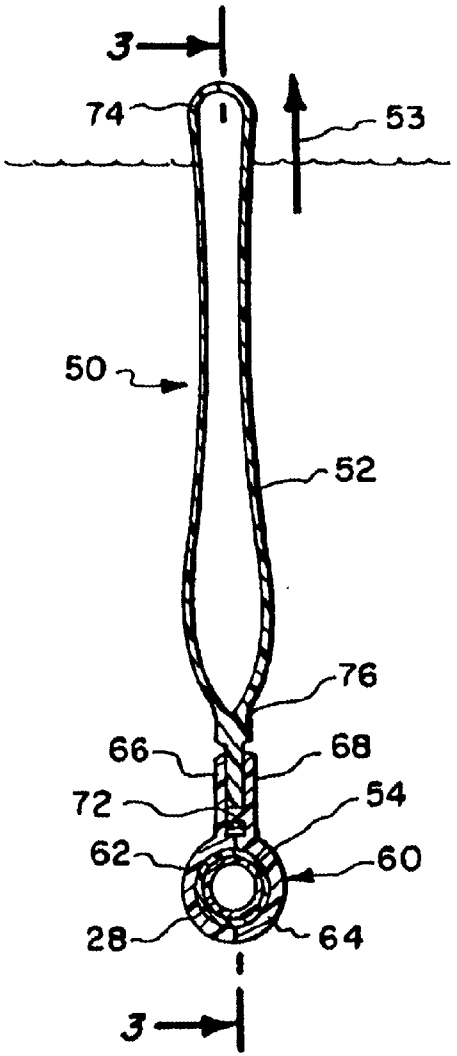
FIG. 2 is a sectional end view taken substantially along the plane 2—2 of FIG. 1A.
Figure 3:
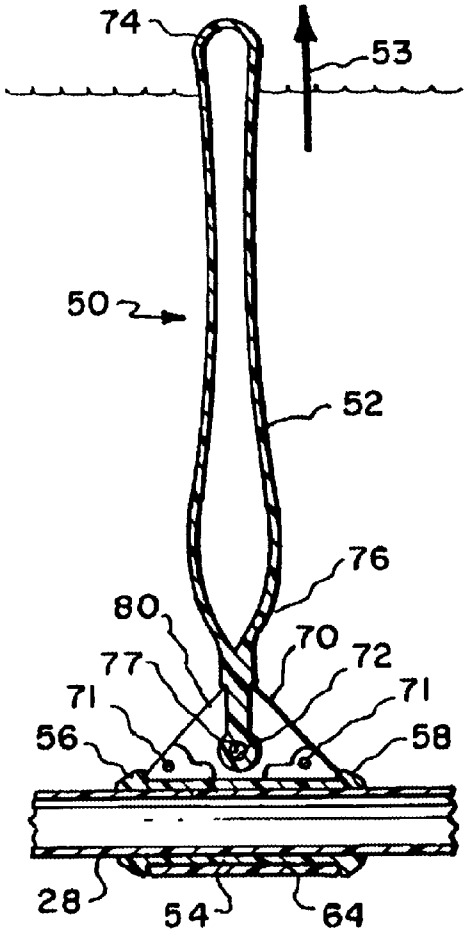
FIG. 3 is a sectional view taken substantially along the plane 3—3 of FIG. 2.
Figure 4:
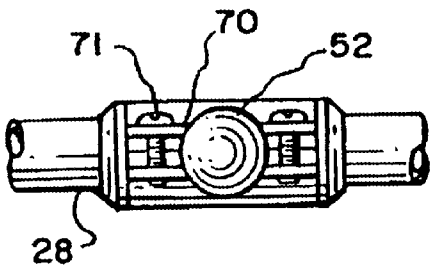
FIG. 4 is a top view of the buoyancy member of FIG. 2.

FIGS. 1B and 1C schematically depict a buoyancy subassembly 34, comprised of a buoyancy member 35 and a link 36, for suspending the conduit 28 and enabling the buoyancy member 35 to move relative to the conduit. Although the link 36 can be flexible, e.g., a length of string, it is preferable to use a substantially rigid link as depicted in FIGS. 2–4 to be discussed hereinafter. Regardless of the specific structure of link 36, the link functions to afford the buoyancy member 35 freedom of movement relative to conduit 28 as shown in FIGS. 1B and 1C, to allow the buoyancy member 35 to be moved out of the way by the cleaner as it is propelled along its travel path.

Figure 5B:
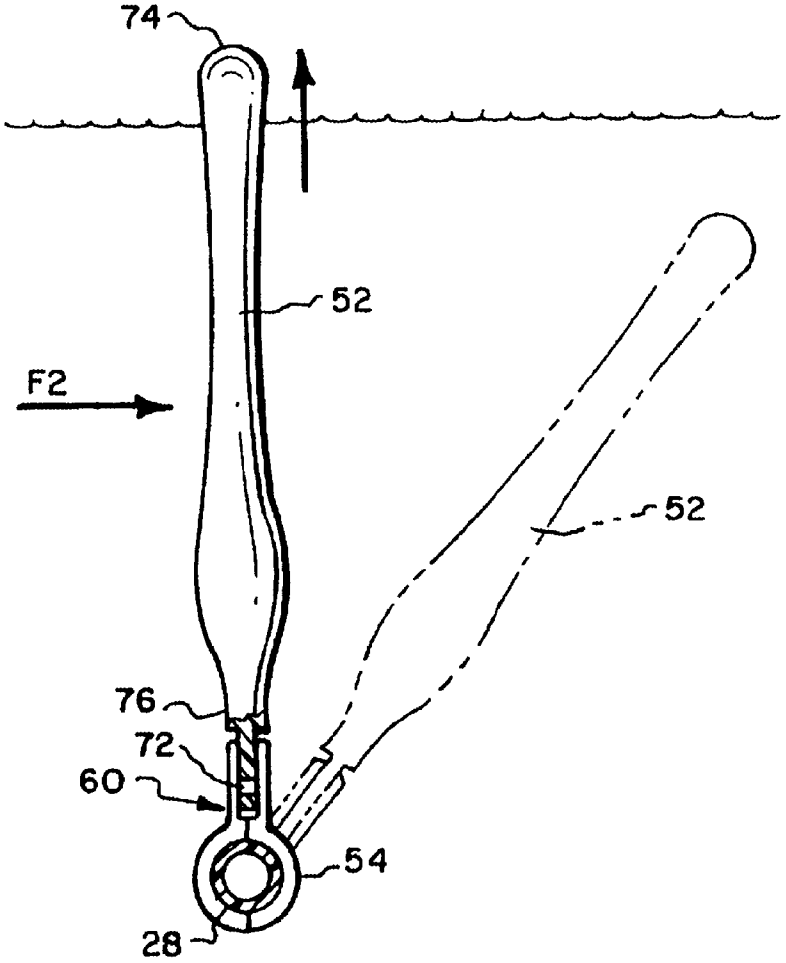
FIGS. 5A and 5B respectively depict how the buoyancy member of FIGS. 2–4 can be moved out of the way when pushed by the cleaner.
Figure 5A:
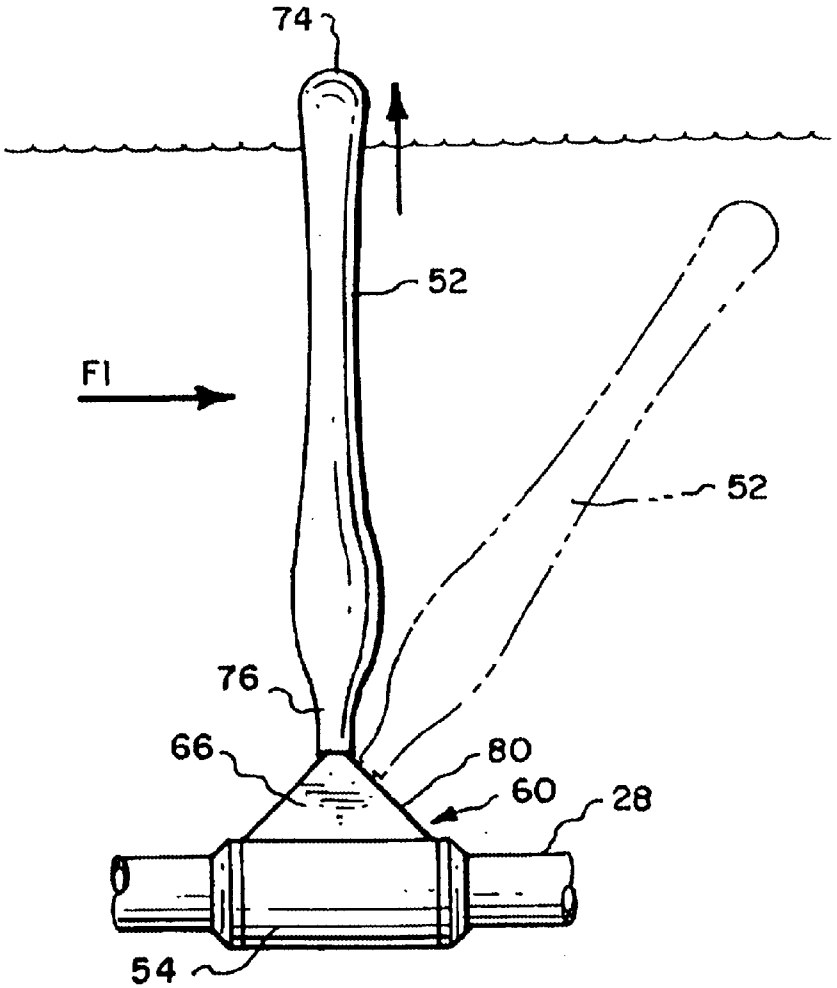

Attention is now directed to FIGS. 2–4 which depict a preferred buoyancy subassembly 50 comprised of a substantially rigid elongate member or stick 52 exhibiting positive buoyancy, represented by up arrow 53. The subassembly 50 includes an inner sleeve 54 dimensioned to snugly fit around conduit 28. The sleeve 54 terminates in outwardly extending end flanges 56, 58. A ring member 60 is mounted on sleeve 54 for rotation therearound between flanges 56, 58. The ring member 60 is preferably formed of mating semicylindrical members 62, 64. Members 62, 64 respectively define radially extending opposed cheeks 66, 68. Cheeks 66, 68 carry spacers 70 which extend toward one another for engagement and to receive fasteners 71, e.g., screws, to secure members 62, 64 together. A pin 72 extending between cheeks 66, 68 defines a pivot axis for mounting the buoyancy member 52 for pivotal motion as represented in FIGS. 5A and 5B. As a consequence of the aforedescribed construction, the buoyancy member 52 is able to (1) rotate around conduit 28 and (2) pivot around pin 72 between an orientation substantially perpendicular to the conduit and an orientation substantially parallel to the conduit.

The substantially rigid elongate buoyancy member 52 can be hollow or foam filled having a first free end 74 and a second end 76 apertured at 77 for receiving the pivot pin 72. The effective buoyancy of the elongate member 52 can be uniformly distributed along its length but is preferably concentrated toward the second apertured end 76, i.e., close to the pivot axis defined by pin 72.

The buoyancy members 52 are preferably configured and dimensioned to float vertically and suspend the conduit below the water surface 14. For example, a typical buoyancy member 52 is configured so that at rest, its first free end normally projects just above the water surface 14 and suspends the conduit 28 up to approximately two foot below. The buoyancy subassemblies 50 are distributed along the conduit's length at intervals, for example, three feet, which depend upon various factors including the weight/buoyancy characteristics and stiffness of the conduit.

FIG. 5A depicts a force component F1 (attributable, for example, to contact by cleaner 22) applied to the buoyancy member 52. The cheeks 66, 68 are preferably provided with ramp surfaces 80 which function to move the cleaner 22 away from conduit 28 to space the application point of force F1 further away from the pivot axis defined by pin 72. By increasing the spacing between the force application point and pivot pin 72, the moment arm produced by the force is increased thus making it easier for the cleaner to pivot the buoyancy member 52 around pin 72 to move it out of the cleaner's travel path to enable the cleaner to pass over conduit 28. FIG. 5B is similar to FIG. 5A and depicts how force component F2 acts to rotate ring member 60 around sleeve 54 to move buoyancy member 52 out of the cleaner's travel path.

Figure 6:
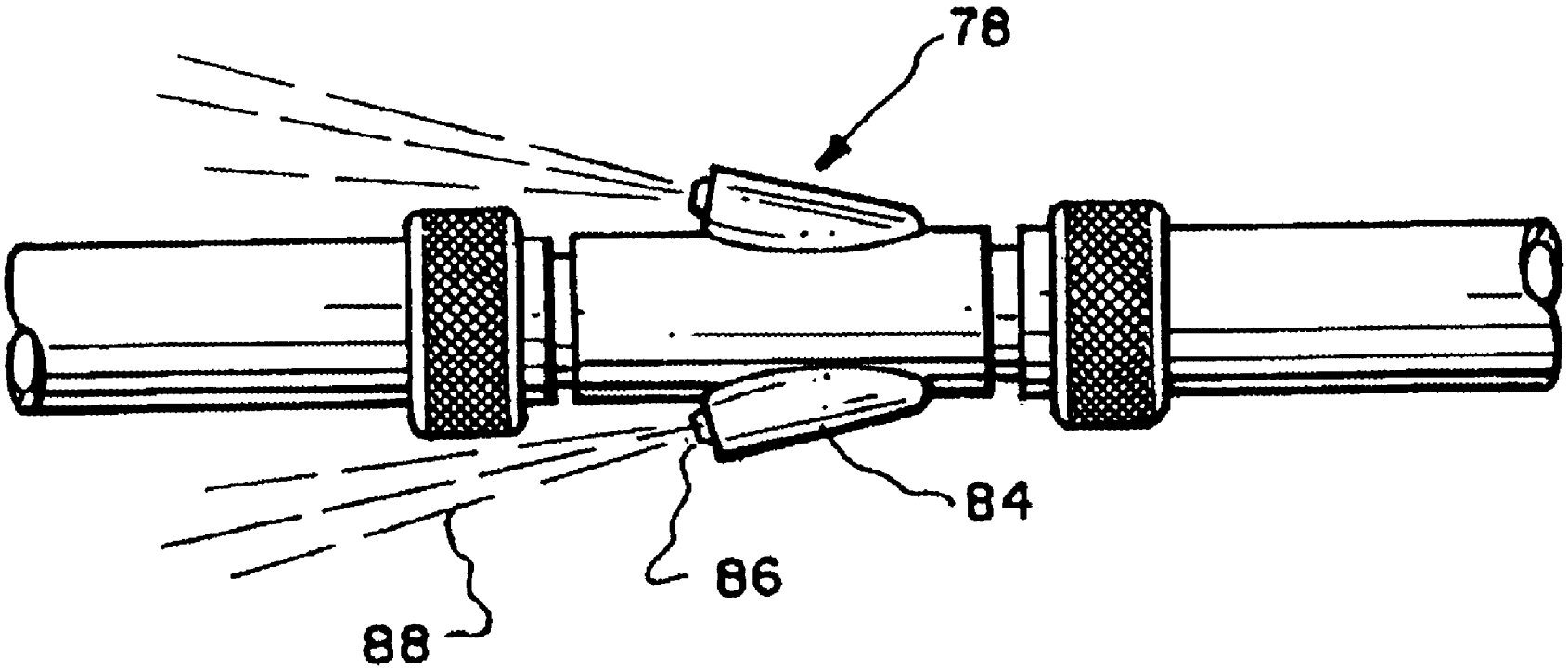
FIG. 6 depicts a propulsion device mounted on the conduit for generating a force to propel the conduit.

In operation, energy delivered to the cleaner via conduit 28 functions to propel the cleaner forwardly through the pool, pulling conduit 28 behind it. The conduit 28 thus exerts a drag force on the cleaner which influences the cleaner's travel path and speed of travel through the pool. In accordance with preferred embodiments of the invention, conduit drag is reduced by mounting one or more propulsion devices 78 on the conduit 28, as depicted at 80A and 80B in FIG. 1A. The propulsion device 78 functions to extract a small amount from the energy being delivered by the conduit for the purpose of generating a propulsion force on the conduit in a direction to reduce its drag on cleaner 22. FIG. 6 depicts an exemplary propulsion device 78 for use with a conduit delivering positive pressure water to the cleaner 22. The device 78 of FIG. 6 is comprised of a body 84 defining one or more outlets 86 oriented to discharge a water stream 88. The discharged stream is preferably directed to produce a propulsion force component along the conduit to reduce the conduit's drag on the cleaner 22 and generate forces which act on the cleaner to enhance the randomness of its path.

From the foregoing, it should now be understood that the embodiment thus far described with reference to FIGS. 1-6 suspends a conduit having an effective specific gravity >1.0 below the water surface 14, e.g., by about 0.5 to 2.5 feet. Consequently, a cleaner 22 is able to travel along the water surface and pass over the suspended conduit without being impeded.

Figures 7A, 7B, 7C:
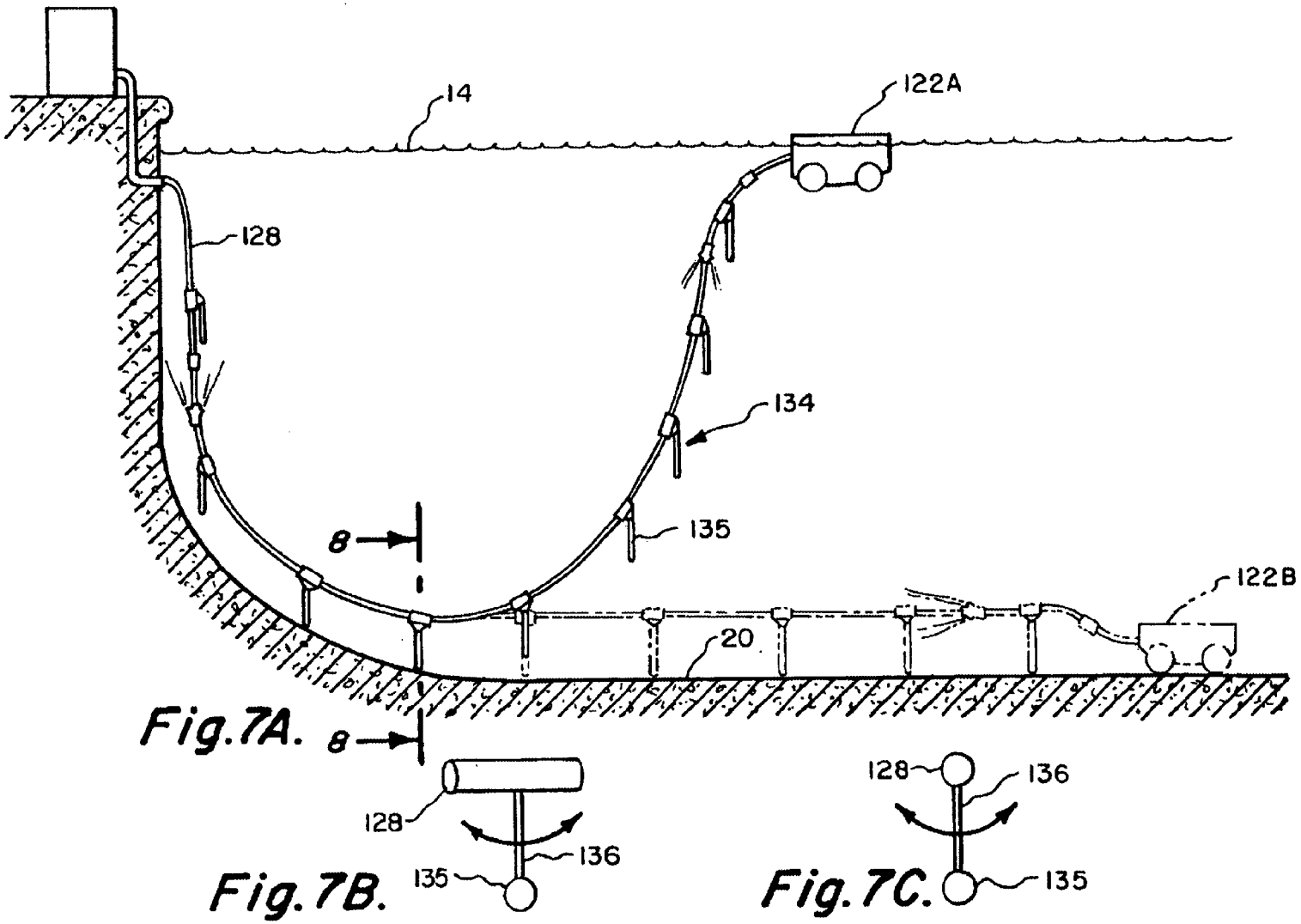
FIG. 7A is a schematic diagram similar to FIG. 1A but showing use of a conduit assembly including weight members for anchoring a conduit.
FIGS. 7B and 7C schematically depict an exemplary weight member for anchoring the conduit and mounted for movement relative thereto.

Attention is now directed to FIGS. 7A–7C, 8 and 9A, 9B which depict an embodiment which anchors a conduit 128 having an effective specific gravity <1.0 above the pool floor. This enables a cleaner 122 (shown in dashed line 122B) to travel along the wall (floor) surface and pass beneath the anchored conduit 128 without being impeded. When the cleaner 122 operates at the water surface (represented at 122A), conduit 128 sinks as shown in FIG. 7A.

In order to anchor the conduit 128, a plurality of weight subassemblies 134 are attached to the conduit spaced along its length. As represented in FIGS. 7B and 7C, each weight subassembly is comprised of a negative buoyancy, i.e., weight, member 135 and a link 136 coupling the weight member to the conduit 128. Although the link 136 can be flexible, it is preferable to use a substantially rigid link as depicted in FIG. 8.

Figure 8:
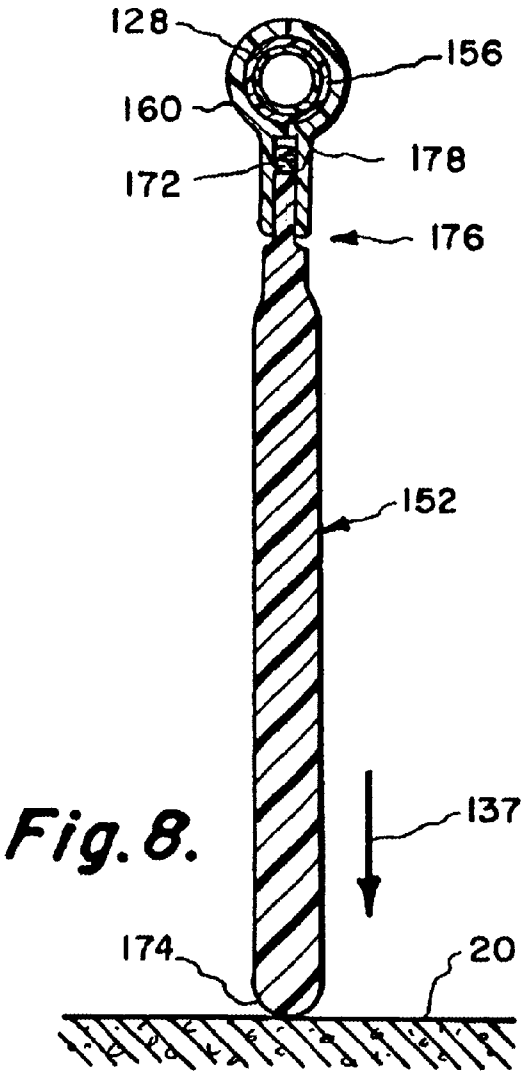
FIG. 8 is a sectional view taken substantially along the plane 8—8 of FIG. 7A.

More particularly, the preferred weight subassembly 134 depicted in FIG. 8 is constructed substantially identically to the buoyancy subassembly of FIGS. 2–4 but is comprised of members which introduce weight (negative buoyancy represented by down arrow 137) in lieu of positive buoyancy. Thus, weight subassembly 134 includes a substantially rigid elongate weight member 152, a sleeve 156 dimensioned to fit snugly around conduit 128 and a ring member 160 mounted on sleeve 156 for rotation therearound. Ring member 160 can be constructed identically to aforedescribed ring member 60, defining a pivot pin 172 for mounting weight member 152 for pivotal motion. More particularly, weight member 152 has a first free end 174 and a second end 176 apertured at 178 for receiving the pivot pin 172.

Figure 9B:
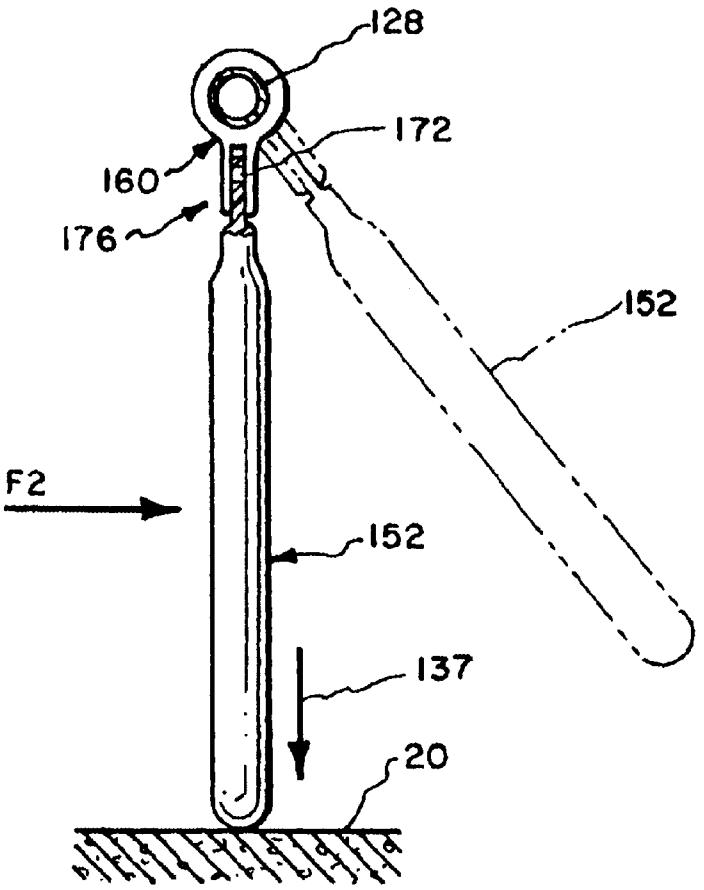
FIGS. 9A and 9B depict relative movement between the weight member and conduit when pushed by the cleaner.
Figure 9A:
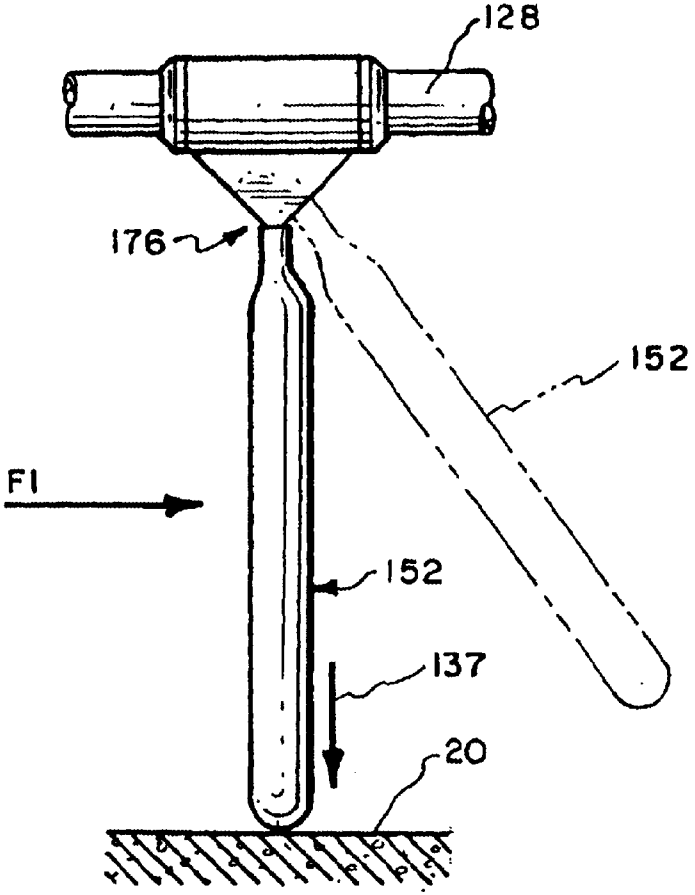

In use, the cleaner 122B (FIG. 7A) traveling along the floor surface 20 will pass under the anchored hose 128. If it engages a weight member 152 to impart a force component F1 represented in FIG. 9A, it will pivot the weight member around the pivot axis defined by pin 172 relative to the conduit (corresponding to aforedescribed FIG. 5A) to allow the cleaner to move along its travel path unimpeded. FIG. 9B depicts the cleaner generating a force component F2 (corresponding to aforedescribed FIG. 5B) for rotating ring member 160 around conduit 128.

From the foregoing, it should now be understood that conduit assembly embodiments have been described herein which situate a pool cleaner conduit at a level between the water surface and floor surface to avoid obstructing the cleaner's travel. Although specific embodiments have been described, it is recognized that alternative structures will occur to those skilled in the art falling within the spirit and scope of the invention as defined by the appended claims.

What is claimed is:

1. A conduit assembly, including an elongate conduit for coupling a power source to a cleaner adapted to travel through a water pool, for situating the conduit at a level below the water surface of said pool and above the floor surface of a wall containing said pool, said assembly comprising:

at least one substantially rigid elongate buoyancy member having a first end and a second end; and an attachment device attached to said conduit and coupled to said buoyancy member second end;

said attachment device being configured to permit movement of the buoyancy member relative to the conduit for enabling said cleaner to push the buoyancy member out of the way as the cleaner travels above and/or below said conduit.

2. The assembly of claim 1 wherein said conduit has a specific gravity >1.0 and said buoyancy members exhibit positive buoyancy.

3. The assembly of claim 1 wherein said conduit has a specific gravity <1.0 and said buoyancy members exhibit negative buoyancy.

4. The assembly of claim 1 wherein said attachment device is configured to permit the buoyancy member coupled thereto to rotate around said conduit.

5. The assembly of claim 1 wherein said attachment device is configured to permit the buoyancy member coupled thereto to pivot about a pivot axis between an orientation substantially perpendicular to said conduit and an orientation substantially parallel to said conduit.

6. The assembly of claim 5 wherein said attachment device is configured to displace said cleaner and/or conduit from said pivot axis prior to engaging said buoyancy member.

7. The assembly of claim 1 including at least one propulsion device carried by said conduit.

8. The assembly of claim 1 including a propulsion device carried by said conduit for discharging a water jet therefrom.

9. The assembly of claim 1 wherein said conduit is comprised of elongate sections coupled by a swivel coupling.

10. A conduit assembly for delivering power to a pool cleaner configured to travel along the water surface of a pool and/or the wall surface of a wall containing said pool, said conduit assembly comprising:

an elongate conduit having an effective specific gravity >1.0;

at least one substantially rigid elongate buoyancy member; and means attaching said buoyancy member to said conduit for enabling said buoyancy member to float proximate to said water surface and suspend said conduit therefrom;

said attaching means allowing said buoyancy member freedom of movement relative to said conduit for enabling said buoyancy member to move and avoid obstructing said cleaner's travel.

11. The assembly of claim 10 wherein said buoyancy member has a first free end and a second end coupled by said attaching means to said conduit.

12. The assembly of claim 10 wherein said attaching means includes a coupling providing freedom of movement in at least two directions.

13. The assembly of claim 10 wherein said attaching means permits said buoyancy member to pivot between an orientation substantially perpendicular to said conduit and an orientation substantially parallel to said conduit.

14. The assembly of claim 10 including at least one propulsion device carried by said conduit.

15. The assembly of claim 10 wherein said conduit is comprised of elongate sections coupled by a swivel coupling.

16. A conduit assembly for delivering power to a pool cleaner configured to travel along the water surface of a pool and/or the wall surface of a wall containing said pool, said conduit assembly comprising:

an elongate conduit having an effective specific gravity <1.0;

at least one substantially rigid elongate weight member; and means attaching said weight member to said conduit for enabling said weight member to sink to the wall surface floor to anchor said conduit;

said attaching means allowing said weight member freedom of movement relative to said conduit for enabling said weight member to avoid obstructing said cleaner's travel.

17. The assembly of claim 16 wherein said weight member has a first free end and a second end coupled by said attaching means to said conduit.

18. The assembly of claim 16 wherein said attaching means permits said weight member to move around said conduit.

19. The assembly of claim 16 wherein said attaching means permits said weight member to pivot between an orientation substantially perpendicular to said conduit and an orientation substantially parallel to said conduit.

20. The assembly of claim 16 including at least one propulsion device carried by said conduit.

21. The assembly of claim 16 wherein said conduit is comprised of elongate sections coupled by a swivel coupling.

22. A system for cleaning a pool having a water surface and contained by a wall having a wall surface, including side and floor surface portions, said system comprising:

a cleaner adapted to travel along a path therethrough said pool along said water surface and/or said wall surface;

an elongate conduit for coupling a power source to said cleaner for propelling said cleaner along said travel path;

a plurality of substantially rigid elongate buoyancy members;

a plurality of attachment devices, each coupling a different one of said buoyancy members to said conduit for situating the conduit below said water surface and above said floor surface for enabling said cleaner to pass above or below said conduit; and wherein each of said attachment devices is configured to permit movement of the buoyancy member coupled thereto relative to said conduit for permitting the cleaner to engage and move the buoyancy member to avoid obstructing the cleaner's travel along said path.

23. The assembly of claim 22 wherein said conduit has a specific gravity >1.0 and said buoyancy members exhibit positive buoyancy.

24. The assembly of claim 22 wherein said conduit has a specific gravity <1.0 and said buoyancy members exhibit negative buoyancy.

25. The assembly of claim 24 wherein said conduit is comprised of elongate sections coupled by a swivel coupling.

26. The assembly of claim 22 wherein each buoyancy member has a first free end and a second end coupled to an attachment device.

27. The assembly of claim 22 wherein each attachment device is configured to permit the buoyancy member coupled thereto to rotate around said conduit.

28. The assembly of claim 22 wherein each attachment device is configured to permit the buoyancy member coupled thereto to pivot about a pivot axis between an orientation substantially perpendicular to said conduit and an orientation substantially parallel to said conduit.

29. The assembly of claim 28 wherein said attachment device is configured to displace said cleaner and/or conduit from said pivot axis prior to engaging said buoyancy member.

30. The assembly of claim 22 including at least one propulsion device carried by said conduit.

31. The assembly of claim 22 including a propulsion device carried by said conduit for discharging a water jet therefrom.

32. A method of cleaning a pool having a water surface and contained by a wall having a wall surface including side and floor surface portions, said method comprising:

providing a cleaner configured to travel along a path through said pool along said water surface and/or said wall surface;

coupling an elongate conduit to said cleaner for supplying energy thereto for propelling said cleaner along said path; and attaching at least one substantially rigid elongate buoyancy member to said conduit for situating said conduit at a level between said pool water surface and said floor surface for enabling said cleaner to push the buoyancy member out of the way as the cleaner travels along said path above and/or below said conduit.

33. The method of claim 32 wherein said conduit has a specific gravity >1.0 and said buoyancy member exhibits positive buoyancy and functions to suspend said conduit below said water surface.

34. The method of claim 32 wherein said conduit has a specific gravity <1.0 and said buoyancy member exhibits negative buoyancy and functions to anchor said conduit above said floor surface.

* * * * *